United States Patent [19]

Sarda

[11] Patent Number: 4,805,531

[45] Date of Patent: Feb. 21, 1989

[54] THERMOGRAPHIC MACHINE FOR RELIEF PRINTING

[76] Inventor: Jean L. Sarda, 25, Rue Pradier, 75019 Paris, France

[21] Appl. No.: 102,870

[22] Filed: Sep. 30, 1987

Related U.S. Application Data

[63] Continuation of Ser. No. 850,739, Apr. 11, 1986, abandoned.

[51] Int. Cl.[4] ..... B41J 3/02

[52] U.S. Cl. ..... 101/488; 400/120; 219/388; 219/216

[58] Field of Search ..... 400/120; 101/426, 226–227; 219/216 R, 388; 346/76 R

[56] References Cited

U.S. PATENT DOCUMENTS

| | | | |
|---|---|---|---|
| 3,440,944 | 4/1969 | Endermann et al. | 219/388 |
| 3,813,516 | 5/1974 | Kudsi | 219/388 |
| 3,994,221 | 11/1976 | Littleton | 101/227 |
| 4,080,158 | 3/1978 | Kondo et al. | 219/216 |
| 4,096,801 | 6/1978 | Martin | 101/227 |
| 4,114,021 | 9/1978 | Nishidi et al. | 219/216 |
| 4,118,178 | 10/1978 | Calvi et al. | 219/216 |
| 4,121,089 | 10/1978 | Bishop | 219/388 X |
| 4,389,114 | 6/1983 | Westerman | 219/216 |
| 4,485,294 | 11/1984 | Rosenberg | 346/76 R |
| 4,501,072 | 2/1985 | Jacobi, Jr. et al. | 219/388 |

*Primary Examiner*—Eugene H. Eickholt
*Attorney, Agent, or Firm*—James E. Bradley

[57] ABSTRACT

A thermographic machine for relief printing enables one to treat a printed paper comprising several settings and to cut laterally and transversely. The printed paper is placed by the printing press on the conveyor of the cutting device. Circular knives slit the printed paper longitudinally. Lateral guides separate the strips of paper before the powdering. The strips are powdered and then go under a heat generator of pulsated hot gas. After cooling, the strips are conveyed to a transverse cutter, which cuts the strips into cards.

9 Claims, 5 Drawing Sheets

THERMOGRAPHIC MACHINE FOR RELIEF PRINTING

This application is a continuation of Ser. No. 850,739, filed Apr. 11, 1986 and now abandoned.

BACKGROUND OF THE INVENTION

1. Field of the Invention

The present invention relates to thermographic machines for relief printing.

2. Description of the Prior Art

Thermographic is a known process. It enables, from a typographic printing, offset or other, to obtain a relief or raised printing.

The transformation in relief is simple and consists of sprinkling a freshly printed sheet of paper while the ink is still wet, with a powder having the ability to melt under heat. After fusion due to heat, a film in relief is created.

The wet ink retains only the powder, and the excess is continuously recycled. The powder printed paper then goes through a tunnel-shaped furnace. At the exit, a stream of fresh air cools the paper and instantaneously congeals the viscous film in relief to prevent the sheets of paper from sticking to each other.

The relief automatic transformation is operated in the following manner: The paper, exiting from the printing press, is received directly on the carrying bands and goes successfully under the powdering assembly, inside the tunnel-shaped furnace and onto a last conveyor to cool before going into a receiving tub.

The current machines in use present the following shortcomings and faults: They do not enable to change into relief a printed paper comprising several settings and to simultaneously cut it. The printer has to take the printed paper in relief and cut it with another machine called a slitter. This proceeding brings additional expensive manipulations. Also, the prior art powdering assemblies are equipped with powder vacuum assemblies which are not reversible from one side to the other of the machine. Thermographic machines are often moved from one printing press to another in the same shop, and the placement of the controls for the different printng presses differ. Depending upon the type of printing press, the lack of reversibility of a powder vacuum chamber may result in an operator of the printing press having difficulty watching the operation of the powder vacuum chamber.

Another inconvenience is found in the manner normally used in heating the coat of powder destined to become the film foring the relief. In the prior art, the heating is obtained in a tunnel-shaped furnace, electric or gas, in which passes the powdered printed paper.

With this principle, the paper or support for the powder must progressively reach the temperature of fusion of the powder, of about 90 to 100 degrees centigrade. The length of warming time of the paper, particularly in the case of high gram weight paper, requires furnaces of great length to obtain rapid rates, such as 6,000 to 8,000 pieces per hour. The hot air obtained by convection inside the furnace is about 300 to 450 degrees centigrade. This air is not pulsated onto the printed paper in the prior art convection machine.

This procedure results in a number of problems. Most tunnel-shaped furnaces are very large. It is difficult to treat heavy paper without risk of damage. Cooling of the printing paper, after fusion, is difficult and costly because of the high expense of energy necessary to remove the heat absorbed by the paper during its heating. The paper also dehydrates due to the heat, which is detrimental to its dimensional stability.

SUMMARY OF THE INVENTION

The present invention has cutting devices which will cut the paper in one direction and also successfully in two directions.

The powdering assembly of the present invention has a vacuum chamber, with the vacuum source selectively being movable from one side to the other of the vacuum chamber. Change of the vacuum source position requires only a few minutes of the operator, therefore making it easy for the thermographic machine to be moved from one printing press to another.

The heater uses a gaseous fluid at high temperature, variable from 400 to 1000 centigrade. This fluid, slightly pulsating at the surface of the paper, heats the powder and instantly causes its fusion, without having to heat the totality of the mass of paper.

DESCRIPTION OF THE PREFERRED EMBODIMENT

Figure 1:
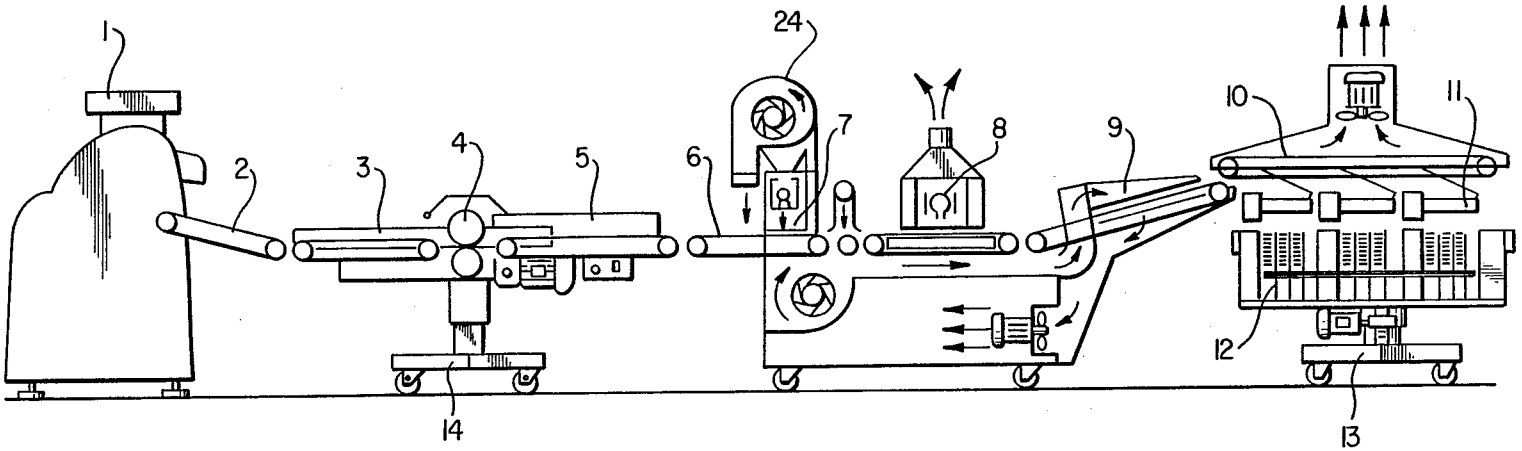
FIG. 1 represents a view of the assembly of a machine constructed in accordance with this invention.

Referring to FIG. 1, a printing press 1 places a printed paper containing wet ink on the conveyor 2 of the first cutting device. Conveyor 2 is equipped with alignment belts 3, which precisely position the printed paper before the paper is engaged by a set of circular cutting blades 4. After cutting the paper into strips 20 (FIG. 2) of paper the strips are aligned by guides 5, which slightly space the strips apart from each other apart to their powdering. Powdering is necessary, because if the strips of paper are too close to each other, they do not allow, after powdering, a good suction through the vacuum chamber 24 of the excess powder not kept by the wet ink. The powder may infiltrate itself on the sides of the strips. Moreover, the suction created by the vacuum chamber 24 between the strips 20, if touching each other, may be poor and may leave a little powder on the conveyor 6. Three millimeters of space at a minimum are indispensible for a good recycling of the excess of powder.

Printed strips 20 (FIG. 2) cross under the powdering assembly 7. The powdering assembly 7 conventionally drops a curtain of powder onto the strips while the ink is still wet. The powdering assembly 7 also removes excess powder that does not adhere to these strips. The strips 20 pass under the generator 8 of hot pulsating gas and then proceed to the cooling conveyor 9. The printed strips are vacuumed and carried on a negative air conveyor 10, which is located at the end of the cooling conveyor 9. They are then detached from the suction of the conveyor 10 by fingers 10C (FIG. 6A) placed between the carrying bands of conveyor 10. The fingers 10C release the paper strips 20 onto the conveyor 28 (FIG. 6A) of the transverse cutter 11. Each cutting element of transverse cutter 11 is interchangeable and adapts itself to the next element from which it gets its different movements. Each paper strip 20, after being aligned and cut transversely, is received and subdivided on a table 12. The strips are stacked, with a height that varies in order to maintain the level of the pile of paper constant. This mode of operation enables for example in the case of business cards printed by eighteen rows, represented by three strips of six cards, to obtain eighteen cards in relief at the rate of 8,000 to 10,000 samples per hour, or about 150,000 cards per hour.

These cards are then aligned and ready to wrap. Each assembly of the two cutting devices 11, 4 is mounted on a pedestal 13, 14, respectively, of a variable height in order to adjust itself to the height of any thermographic machine. The pedestals 13 and 14 are equipped with wheels for easy displacement.

In the case where the printer treats successfully printed paper strips with several sets in a non-relief, it can without difficulty use the same chain of treatment. All he needs to do in the second case is to stop the powdering and the generation of pulsating gas.

Figure 2:
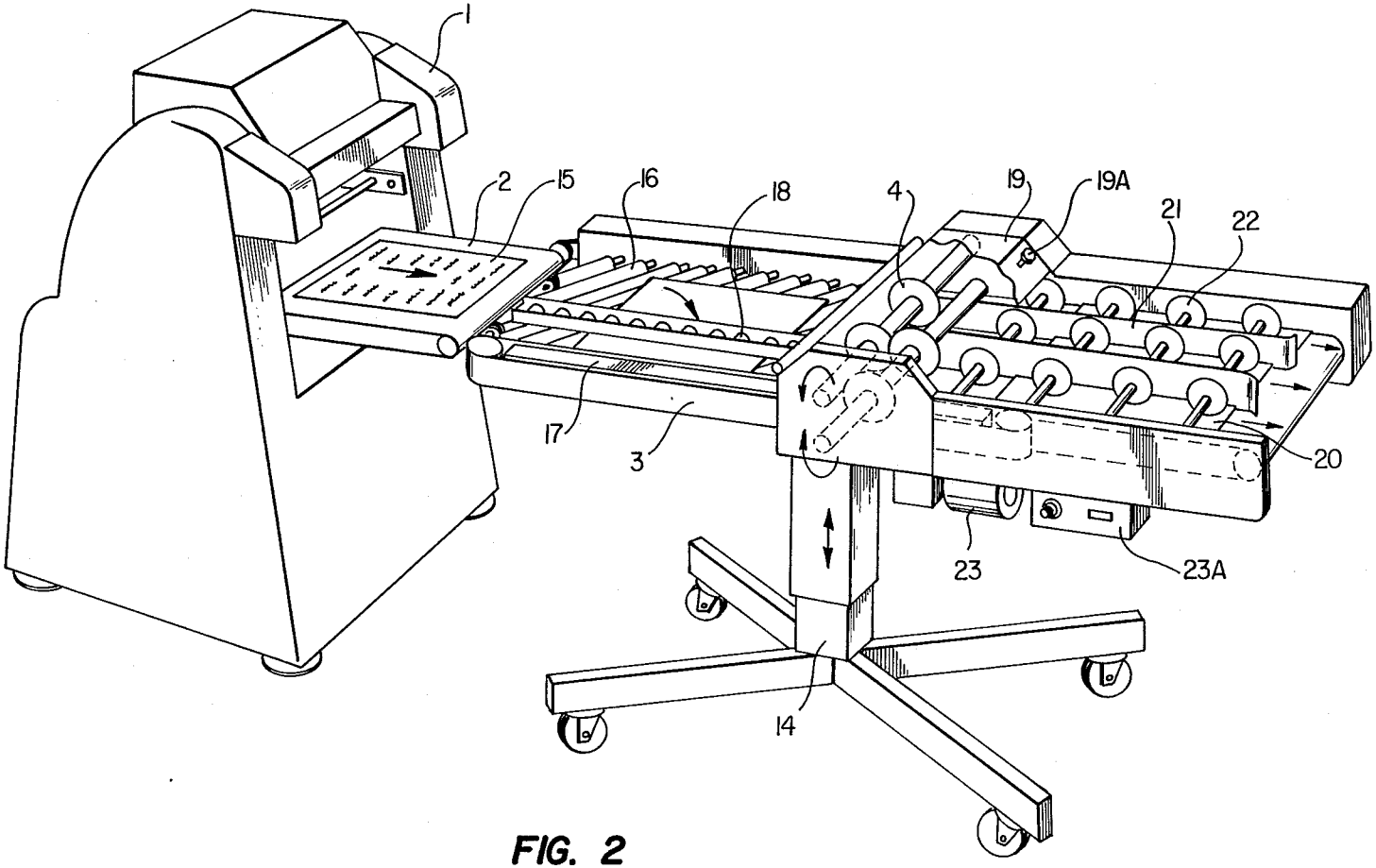
FIG. 2 represents a view in perspective of the first cutting device incorporated between the printing press and thermographic machine of the assembly shown in FIG. 1. The first cutting device cuts the printed paper into longitudinal strips before its transformation in relief.

FIG. 2 shows in detail the first cutting device placed between the printing press and the thermographic machine. Conveyor 2 is mounted on a pedestal 14, which has a height adjustable in relation to the height of reception of the printing press 1. Conveyor 2 receives the printed paper 15 and leads it toward a conveyor of alignment. This conveyor consists of oblique rollers 16, which move the printed paper 15 towards an alignment belt 3 giving the cutting reference. This reference must be precise because it conditions the squaring of different cuts.

The thickness of belt 3 and the tilt is controlled by a shoe 17. The printed paper 15 travels under a path of balls to retain the paper 15 during its alignment and its cutting. The balls 15 are made of silicone resin because this material has the ability to be repellent to oily bodies and therefore to printing ink. In this case, and contrary to the traditional cutting devices where the printed paper is cut after transformation into relief, the ink is wet and cannot be put into contact with the usual materials without risking soiling the printed paper and the rollers of alignment. The paper 15 is cut into strips 20 by circular knives 4, protected during functioning by a tilting hood 19. An electric switch 19A shuts off the operation of the assembly when the protective hood 19 is tilted. The cut strips of paper 20 enter the guides 21 for positioning and separating to create a space between each strip 20 before the powdering. The rollers 22 are also made of a resin or elastomeric silicone, for the reasons explained above. The first cutting device 4 is driven by a reducing motor 23 which operates with a continuous current and with an adjustable speed through the intermediate of a variable autotransformer 23A.

Figure 4:
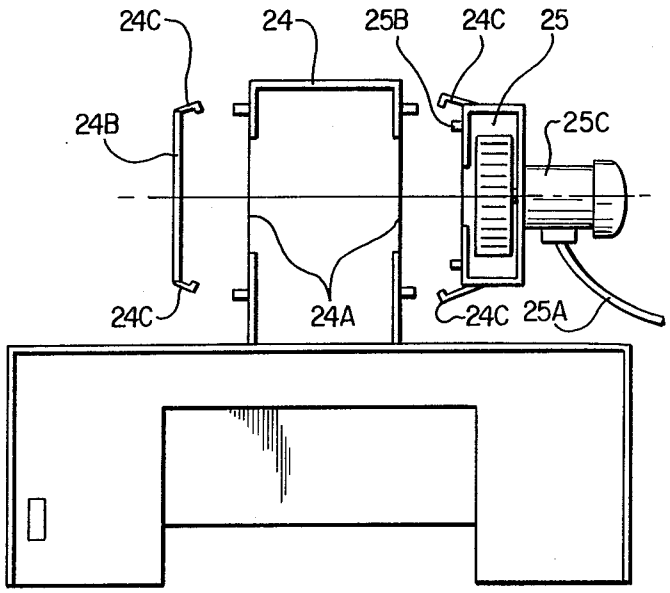
FIGS. 3 and 4 represent a front view of a reversible powder vacuum chamber, showing two different positions.
Figure 3:
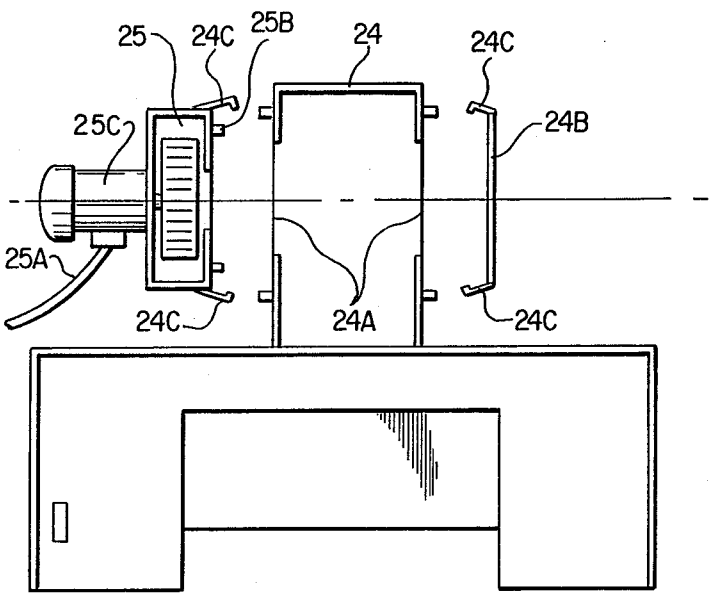

FIGS. 3 and 4 show in front view a powder vacuum chamber 24 with two functioning positions. The body of the vacuum chamber 24 has two openings 24A, one on each side, both symmetric and similar.

The vacuum source 25 for the vacuum chamber 24 and the inspection door 24B for the vacuum chamer 24 are equipped with hooks 24C enabling each to hook itself either on one side or the other of the vacuum chamber 24. The flexible electrical cord 25A of the motor 25C of vacuum source 25 follows the motor 25C without difficulty in case of change of position. A rubber foam 25B (about 10 millimeters thick), insures the tightness between the vacuum source 25 and the lateral walls of the vacuum chambers 24. FIG. 3 shows the vacuum source 25 on the left side and FIG. 4 shows the vacuum source 25 on the right side.

Figure 5:
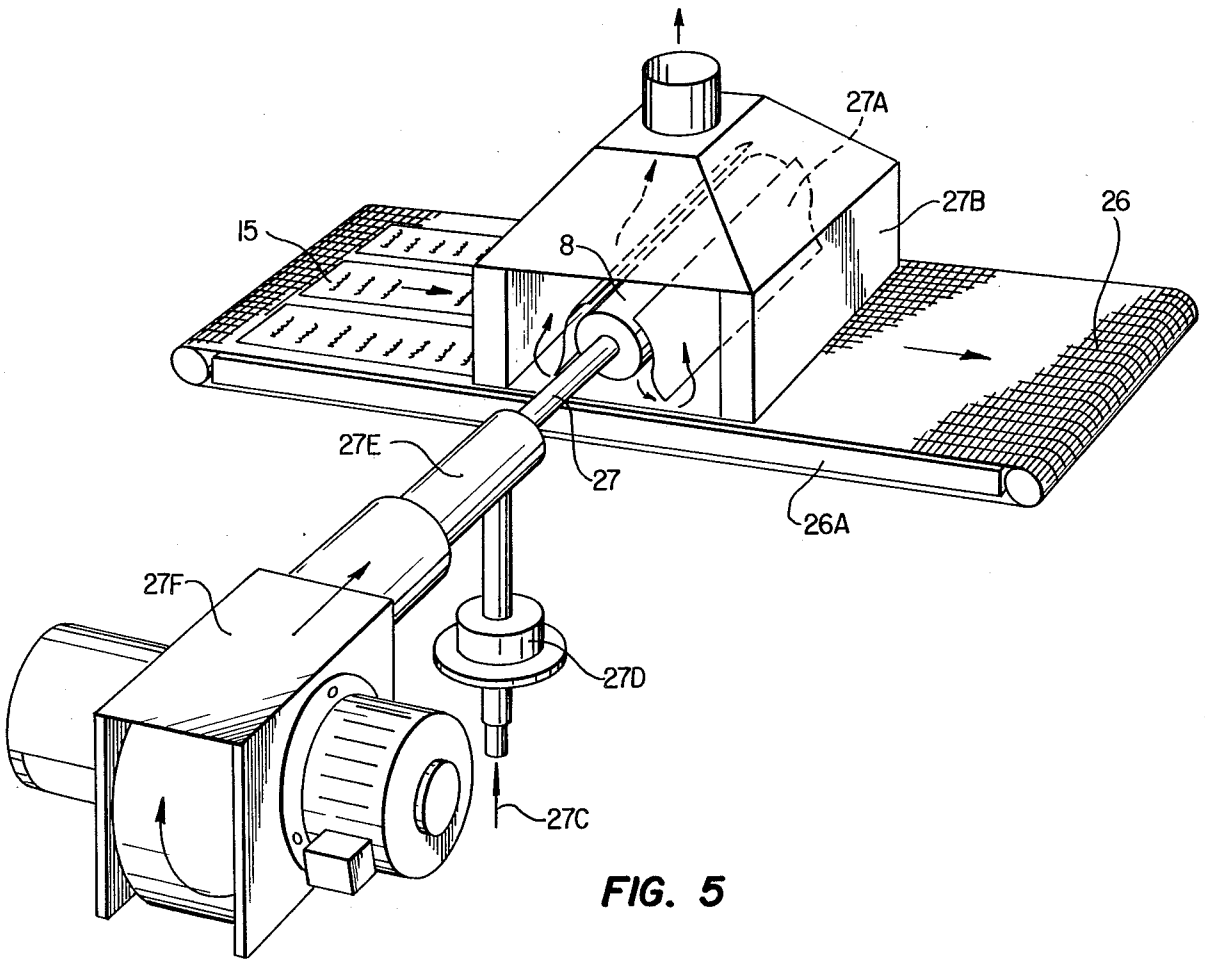
FIG. 5 represents a view in perspective of a gas generator pulsating at high temperature.

FIG. 5 represents, in perspective, a gas generator pulsated at high temperatures. A metallic conveyor 26 with steel mesh rotates on a refractory steel box 26A, internally equipped with insulation material for isolating heat. After being powdered, the strips of paper 20 run on the conveyor 26 and pass rapidly under the generator 8 so that fusion happens instantly. The generator 8 has one or several burners 7, depending upon the rate desired. Diffusers 27A diffuse the hot gases. A heat resistant box 27B in the shape of a chimney, tops the assembly and allows the evacuation of the burnt gases.

The function of the burner is as follows: The gas under pressure from conduit 27C passes through a regulating relief valve 27D from which it exits at about a pressure of 20 grams per square centimeter. It is then channeled and introduced in a mixer 27E where it mixes with air coming from the ventilator 27F. The air is distributed at a pressure of approximately 10 grams per square centimeter.

Contrary to the convection furnace of the prior art where the printed paper passes in a mass of warm air without pressure, the hot gas, even under light pressure, instantly impregnates the coated powder and makes it melt immediately no matter what the thickness of the paper or support on which the powder is contained. The pressure of the hot gas must be sufficiently weak so that it will not deform the film constituting the relief.

With this method of fusion of the powder, the back of the printing paper is not subjected to a high temperature, the cooling of the printed paper is a lot faster and does not require a cooling conveyor as long. Moreover, the gas generator 8 reaches the desired temperature and cools quickly, which is not the case of the prior art convection furnaces, which require a significant heating and cooling time. This also allows an immediate stop of combustion during the periods of non-feeding of the press or in case of an accident.

Figure 6A:
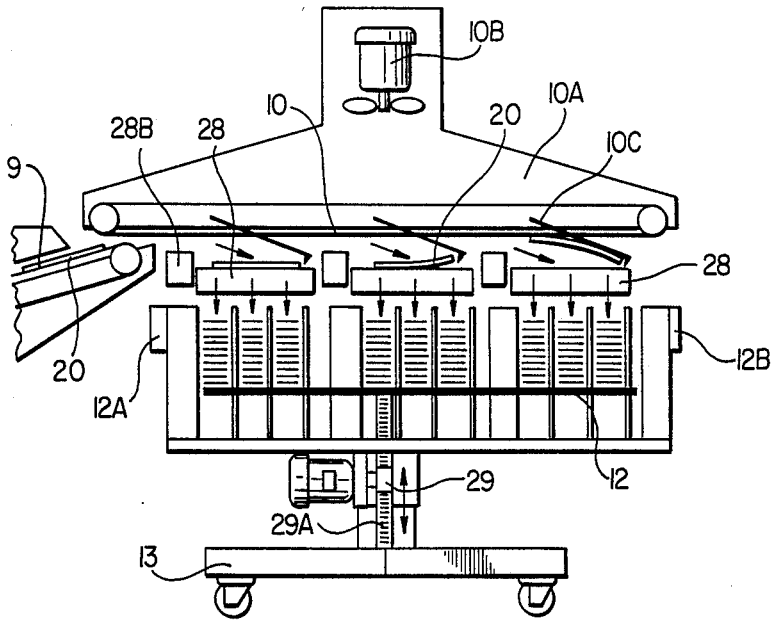
FIGS. 6A and 6B respectively represent a front view and a view from above of a second cutting device, placed at the exit of the thermographic machine. This device enables the transverse cutting of the longitudinal strips.

FIG. 6A represents the front view of the cutting device placed at the exit of the cooling conveyor. Conveyor 10 is equipped with carrying bands between which an upward suction is created with the help of the suction box 10A and the blower 10B. Blower 10B is placed at the upper end of suction box 10A and above the cooling conveyor 9. The printed strips 20 stick on the conveyor 10 due to the negative air pressure in box 10A, until they are pushed by fingers 10C downward from conveyor 10. Fingers 10C are located between the bands of the conveyor 10 and cause the strips 20 to fall downward onto the conveyor 28. Conveyor 28 is at the entrance of the transverse cutter 11.

Each cutting element of the transverse cutter 11 is interdependent and includes an assembly of elements necessary for the cutting of a strips 20 of paper. The printer can equip the machine with one or several cutting elements for the transverse cutter 11, depending upon the number of strips 20 of paper to be cut. The first cutting device of the transverse cutter 11 is driven and transmits its movement to the other devices of transverse cutter 11.

Figure 6B:
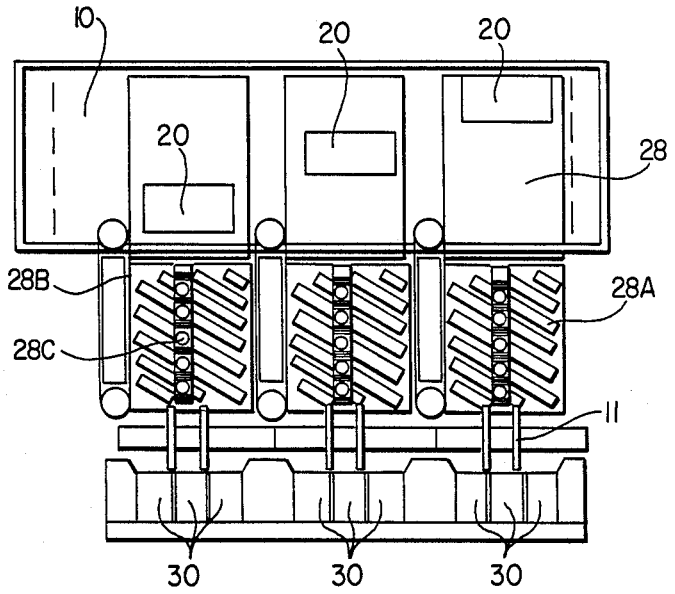

The conveyor 28 leads the strips of paper 20 towards the alignment conveyor constituted of oblique rollers 28A, as shown in FIG. 6B. Rollers 28A serve to move the printed strips 20 of paper toward an alignment belt 28B, which gives the cutting reference. The printed strips 20 of paper pass under a path of balls 28C, which hold the alignment of the strips 20 while they are being cut. The transverse cutter 11, as in the cutting device 4 (FIG. 1) located at the entrance of the thermographic machine, has a plurality of circular knives. The cut printed papers 20 fall as cards onto a receiving table 12. The table 12 is maintained at a constant level with the help of the combination of an optic transmitter 12A and receiver 12B. The transmitter 12A and receiver 12B work with a reducing motor, which acts on a gear 29. Gear 29 engages a rack 29A. The assembly is also mounted on a pedestal 13 equipped with wheels. The circular knives of transverse cutter 11 are interchangeable.

The assembly of the improvements to these machines makes the machine more complete and brings to their user more efficiency. Also, the more selective rendering of the mode of fusion of the powder opens a new application of the procedure by enabling one to decorate and print in relief some very thick materials other than paper, such as wood, agglomerate, etc.

While the invention has been described in only one of its forms, it should be apparent to those skilled in the art that it is not so limited, but is susceptible to various changes without departing from the scope of the invention.

I claim:

1. A thermographic machine for printing in relief, comprising in combination:

conveyor means for receiving from a printer a sheet of printed paper containing wet ink and for transporting the sheet longitudinally;

longitudinal cutter means on the conveyor means for slitting the sheet of printed paper longitudinally into a plurality of strips as the sheet is moved by the conveyor means and while the ink is still wet;

powder means on the conveyor means for distributing a thermographic powder onto the strips as they are moved by the conveyor means, and for removing from the strips powder other than that which adheres to the wet ink on the strips;

heater means on the conveyor means for heating the strips to cause the thermographic powder to fuse as the conveyor means moves the strips from the powder means;

cooling means on the conveyor means for cooling the strips as the conveyor means conveys the strips from the heater means;

transporting means for moving the strips laterally from the conveyor means as the conveyor means conveys the strips from the cooling means; and transverse cutter means on the transporting means for cutting the strips transversely into cards as the transporting means moves the strips laterally.

2. The machine according to claim 1, wherein the heater means comprises:

means for discharging pulses of a hot gas onto the strips.

3. The machine according to claim 1, further comprising spreader means located between the longitudinal cutter means and the powder means for separating the strips laterally from each other.

4. The machine according to claim 1, further comprising guide means located on the conveyor means between the printer and the longitudinal cutter means for holding the sheet of paper on the conveyor means as it enters the longitudinal cutter means, the guide means having a plurality of roller elements formed of a silicone elastomer for repelling the adherence of ink to the roller elements.

5. The machine according to claim 1, wherein the powder means comprises:

a vacuum chamber located above the conveyor means for removing excess powder from the strips, the vacuum chamber having a pair of apertures on opposite sides from each other;

an inspection plate;

a vacuum source; and means for mounting the inspection plate selectively and moveably over each of the apertures, and for mounting the vacuum source selectively and moveably over the other of the apertures.

6. A thermographic machine for printing in relief, comprising in combination:

conveyor means for receiving from a printer a sheet of printed paper containing wet ink and for transporting the sheet longitudinally;

longitudinal cutter means on the conveyor means for slitting the sheet of printed paper longitudinally into a plurality of strips as the sheet is moved by the conveyor means and while the ink is still wet;

powder means on the conveyor means for distributing a thermographic powder onto the strips as they are moved by the conveyor means, and for removing from the strips powder other than that which adheres to the wet ink on the strips;

heater means on the conveyor means for discharging a hot gas onto the strips for heating the powder on the strips to cause the thermographic powder to fuse as the conveyor means moves the strips from the powder means;

cooling means on the conveyor means for cooling the strips as the conveyor means conveys the strips from the heater means;

transporting means for moving the strips laterally from the conveyor means as the conveyor means conveys the strips from the cooling means; and transverse cutter means on the transporting means for cutting the strips transversely into cards as the transporting means moves the strips laterally from the conveyor means.

7. The machine according to claim 6, wherein the heater means comprises;

a burner located over the conveyor means;

a conduit leading to the burner;

a mixing chamber connected to the conduit;

means for flowing a combustible gas into the mixing chamber;

a blower for blowing air into the mixing chamber to mix with the gas and to force the mixture of gas and air to flow into and out of the burner.

8. A thermographic machine for printing in relief, comprising in combination:

conveyor means for receiving from a printer sheets of printed paper containing wet ink and for transporting the sheets;

powder means on the conveyor means for distributing a thermographic powder onto the sheets as they are moved by the conveyor means, and for removing from the sheets powder other than that which adheres to the wet ink on the sheets;

the powder means including a vacuum chamber located above the conveyor means for removing excess powder from the sheets, the vacuum chamber having a pair of apertures on opposite sides from each other;

an inspection plate;

a vacuum source;

means for mounting the inspection plate selectively and moveably over each of the apertures, and for mounting the vacuum source selectively and moveably over the other of the apertures;

heater means on the conveyor means for heating the sheets to cause the thermographic powder to fuse as the conveyor means moves the sheets from the powder means; and cooling means on the conveyor means for cooling the sheets as the conveyor means conveys the sheets from the heater means.

9. A method for thermographically printing in relief, comprising in combination:

conveying from a printer a sheet of printed paper containing wet ink and transporting the sheet on a conveyor longitudinally; then slitting the sheet of printed paper longitudinally into a plurality of strips as the sheet is moved along the conveyor and while the ink is still wet; then distributing a thermographic powder onto the strips as the strips are moved along the conveyor, and removing from the strips powder other than that which adheres to the wet ink on the strips; then discharging a hot gas onto the strips for heating the powder on the strips to cause the thermographic powder to fuse as the strips move along the conveyor; then cooling the strips as the strips are moved along the conveyor; then conveying the strips laterally from the conveyor onto a lateral conveyor; then cutting the strips transversely into cards as the strips move laterally on the lateral conveyor.

* * * * *

UNITED STATES PATENT AND TRADEMARK OFFICE

CERTIFICATE OF CORRECTION

PATENT NO. : 4,805,531

DATED : February 21, 1989

INVENTOR(S) : Jean L. Sarda

It is certified that error appears in the above-identified patent and that said Letters Patent is hereby corrected as shown below:

Title page, after [22] filed insert the following:

Foreign Application Priority Data

--[30] April 12, 1985 [FR] France.....85 05504

Signed and Sealed this

Twentieth Day of March, 1990

*Attest:*

JEFFREY M. SAMUELS

*Attesting Officer*

*Acting Commissioner of Patents and Trademarks*